US008672468B2

(12) United States Patent
Usuda

(10) Patent No.: US 8,672,468 B2
(45) Date of Patent: Mar. 18, 2014

(54) PRINTING APPARATUS, LINE PRINTER AND METHOD FOR PRINTING

(71) Applicant: Seiko Epson Corporation, Tokyo (JP)

(72) Inventor: Hidenori Usuda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/628,566

(22) Filed: Sep. 27, 2012

(65) Prior Publication Data

US 2013/0076819 A1 Mar. 28, 2013

(30) Foreign Application Priority Data

Sep. 28, 2011 (JP) ..... 2011-213177

(51) Int. Cl.
*B41J 2/01* (2006.01)

(52) U.S. Cl.
USPC ..... 347/102; 347/101; 347/5

(58) Field of Classification Search
USPC ..... 347/5, 9, 12, 102, 101
See application file for complete search history.

(56) References Cited

U.S. PATENT DOCUMENTS

2002/0140794 A1* 10/2002 Asano et al. ..... 347/102
2005/0046684 A1 3/2005 Yoneyama
2006/0012630 A1 1/2006 Niekawa
2007/0097195 A1* 5/2007 Nishino ..... 347/102
2007/0188528 A1 8/2007 Kakutani

FOREIGN PATENT DOCUMENTS

JP 2005-074878 A 3/2005
JP 2005-088342 A 4/2005
JP 2006-026970 A 2/2006
JP 2007-175963 A 7/2007

* cited by examiner

*Primary Examiner* — Lam S Nguyen
(74) *Attorney, Agent, or Firm* — Nutter McClennen & Fish LLP; John J. Penny, V.

(57) ABSTRACT

A printing apparatus includes a head section having a nozzle row being configured to emit photocurable ink onto a target and an irradiating section configured to irradiate the target, a moving section configured to move the head section with respect to the target for printing, and a controller configured to carry out control so as to emit the photocurable ink from the nozzles onto an image forming area of the target and to irradiate the photocurable ink having impacted on the image forming area from the irradiation section. The controller controls irradiation energy of the light that the irradiation section irradiates the image forming area with so that irradiation energy of the light that an edge area of the image forming area is irradiated with is smaller than irradiation energy of the light that an area of the image forming area adjacent to the edge area is irradiated with.

8 Claims, 13 Drawing Sheets

PRINTING APPARATUS, LINE PRINTER AND METHOD FOR PRINTING

BACKGROUND

1. Technical Field

The present invention relates to a printing apparatus, a line printer and a method for printing.

2. Related Art

A printer is known, e.g., as one of a printing apparatus configured to emit photocurable liquid which is hardened upon being irradiated with light (e.g., ultra violet light (shortened as "UV"), visible light, etc.) (e.g., ultra violet light-curable ink, shortened as "UV ink"). After emitting UV ink from a nozzle onto a target for printing made of paper, cloth, film sheet, etc., such a printer irradiates dots formed on the target for printing with light. The dots are thereby hardened and are fixed onto the target for printing, e.g., as disclosed in JP-A-2006-26970.

UV ink can be instantaneously hardened by means of UV, and can thereby be used for printing onto a target for printing of non-absorption property. A dot composing a printed image is formed as protruding from the surface of the target for printing compared with that of an image printed onto a target for printing of an absorption property by the use of osmotic ink (e.g., aqueous ink).

Further, when an image is printed onto a target for printing by the use of UV ink, a phenomenon such that a portion of the printed image close to an edge protrudes higher in particular than other portions do (thick protrusion phenomenon) may possibly occur. If the printed image is viewed in condition that light is regularly reflected only on a portion of the printed image because of the thick protrusion phenomenon, the printed image looks solid and is perceived to be thicker than it practically is, causing degraded quality of the printed image.

Thus, an advantage of some aspects of the invention is that quality of an image is enhanced.

SUMMARY

An advantage of some aspects of the invention is that a printing apparatus including a head section, a moving section and a controller is provided. The head section has a nozzle row formed by a plurality of lined up nozzles each being configured to emit photocurable ink to be hardened upon being irradiated with light onto a target for printing, the head section having an irradiation section configured to irradiate the target for printing with the light. The moving section relatively moves the head section with respect to the target for printing in a crossing direction which crosses a direction of the lined up nozzles forming the nozzle row. The controller carries out control so as to emit the photocurable ink from the nozzles onto an image forming area of the target for printing having relatively moved by means of the moving section and to irradiate the photocurable ink having impacted on the image forming area from the irradiation section with the light. The controller controls irradiation energy of the light that the irradiation section irradiates the image forming area with so that irradiation energy of the light that an edge area of the image forming area is irradiated with is smaller than irradiation energy of the light that an area of the image forming area adjacent to the edge area is irradiated with. In other words, irradiation energy of light applied to an area of the image forming area adjacent to the edge area is energy to harden the photocurable ink into the inner part. Irradiation energy of the light applied to the edge area of the image forming area is made weaker than the above to be irradiation energy that the photocurable ink is hardened close to the surface and is not hardened into the inner part with. After protrusion of ink in the edge area collapses and is leveled off, apply light of greater irradiation energy so as to harden the photocurable ink into the inner part.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1A:
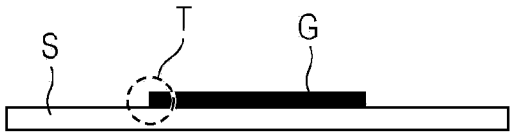
FIG. 1A illustrates a printed image printed on a target for printing by the use of UV ink.

Descriptions in the specification and the drawings disclose at least following matters.

A printing apparatus including a head section, a moving section and a controller is disclosed. The head section has a nozzle row formed by a plurality of lined up nozzles each being configured to emit photocurable ink to be hardened upon being irradiated with light onto a target for printing, the head section having an irradiation section configured to irradiate the target for printing with the light. The moving section relatively moves the head section with respect to the target for printing in a crossing direction which crosses a direction of the lined up nozzles forming the nozzle row. The controller carries out control so as to emit the photocurable ink from the nozzles onto an image forming area of the target for printing having relatively moved by means of the moving section and to irradiate the photocurable ink having impacted on the image forming area from the irradiation section with the light. The controller controls irradiation energy of the light that the irradiation section irradiates the image forming area with so that irradiation energy of the light that an edge area of the image forming area is irradiated with is smaller than irradiation energy of the light that an area of the image forming area adjacent to the edge area is irradiated with. In other words, a printing apparatus is disclosed in such a way that irradiation energy of light applied to an area of the image forming area adjacent to the edge area is energy to harden the photocurable ink into the inner part, that irradiation energy of the light applied to the edge area of the image forming area is made weaker than the above to be irradiation energy that the photocurable ink is hardened close to the surface and is not hardened into the inner part with, and that after protrusion of ink in the edge area collapses and is leveled off, light of greater irradiation energy is applied so that the photocurable ink is hardened into the inner part.

An occurrence of a thick protrusion phenomenon can be controlled by means of such a printing apparatus. Quality of an image to be printed by the use of photocurable ink can thereby be enhanced.

The printing apparatus may be constituted in such a way that the moving section has a carriage equipped with the head section, the carriage being configured to move back and forth in the crossing direction, that the controller repeats a first operation and a second operation, the first operation including making the moving section move the carriage back and forth in the crossing direction, the first operation including emitting the photocurable ink from the nozzles onto the image forming area of the target for printing, the first operation including irradiating the photocurable ink having impacted on the image forming area from the irradiation section with the light, and that the second operation is to transport the target for printing in the direction of the lined up nozzles forming the nozzle row at intervals when the carriage moves back and forth in the crossing direction.

It is preferable for such a printing apparatus that, when the carriage moves back and forth in the crossing direction, the controller makes the irradiation section irradiate the edge area with the light of irradiation energy being smaller than irradiation energy of the light that the irradiation section irradiates the area adjacent to the edge area with on a certain relative move, and that the controller makes the irradiation section further irradiate the edge area irradiated with the light on the certain relative move with the light on another relative move after the certain relative move.

Such a printing apparatus can apply weak irradiation of light so as to harden photocurable ink having impacted on the edge area close to the surface, and further apply light so as to harden the photocurable ink in the edge area after protrusion in the edge area collapses. Liquidity of dots formed in the edge area can thereby be enhanced to any level, and the protrusion in the edge area can further be controlled. The image quality can thereby be enhanced further.

It is preferable for such a printing apparatus that the printing apparatus has a detector configured to detect a position of the carriage relative to the target for printing in the crossing direction, and that the controller changes irradiation energy of the light that the irradiation section applies on the basis of data of the relative position detected by the detector.

Such a printing apparatus can detect an edge position more exactly, and change timing of light application more exactly.

It is preferable for such a printing apparatus that the carriage is provided with the irradiation section on each of one side and an opposite side in the crossing direction with respect to the nozzle row, and that the controller carries out control so that the irradiation section provided on the one or the opposite side which moves, after the carriage moves and the nozzle row comes to a position in the image forming area of the target for printing, to the position applies the light.

Such a printing apparatus can apply light immediately after forming the dots.

It is preferable for such a printing apparatus that the irradiation section is arranged alongside the nozzle row in the crossing direction, and that the controller controls irradiation energy of the light of the irradiation section according to a position in the direction of the lined up nozzles so that irradiation energy of the light of the irradiation section on a position corresponding to a nozzle which emits the photocurable ink onto the edge area in the direction of the lined up nozzles is smaller than irradiation energy of the light that the area of the image forming area adjacent to the edge area is irradiated with.

Such a printing apparatus can control protrusion of an image in the edge area in the direction of lined up nozzles.

Further, what is disclosed may be a line printer including a head section, a moving section and a controller. The head section has a plurality of nozzle rows formed by a plurality of lines of nozzles each being configured to emit photocurable ink to be hardened upon being irradiated with light onto an image forming area of a target for printing, the head section having an irradiation section configured to irradiate the target for printing with the light. The moving section relatively moves the head section with respect to the target for printing in a crossing direction which crosses a line direction of the nozzle rows. The controller carries out control so as to emit the photocurable ink from the nozzles onto the image forming area of the target for printing having relatively moved by means of the moving section, the controller being configured to control the head section so as to irradiate the photocurable ink having impacted on the image forming area from the irradiation section with the light. The controller controls irradiation energy of the light that the irradiation section irradiates the image forming area with so that irradiation energy of the light that an edge area of the image forming area is irradiated with is smaller than irradiation energy of the light that an area of the image forming area adjacent to the edge area is irradiated with.

The line printer is disclosed in such a way that irradiation energy of light applied to an area of the image forming area adjacent to the edge area is energy to harden the photocurable ink into the inner part, that irradiation energy of the light applied to the edge area of the image forming area is made weaker than the above to be irradiation energy that the photocurable ink is hardened close to the surface and is not hardened into the inner part with, and that after protrusion of ink in the edge area collapses and is leveled off, light of greater irradiation energy is applied so that the photocurable ink is hardened into the inner part.

The line printer can level off protrusion in the edge area as well on a line-by-line basis.

Further, what is disclosed is a method for printing an image on a target for printing by means of a printing apparatus including a head section having a nozzle row formed by a plurality of lined up nozzles each being configured to emit photocurable ink to be hardened upon being irradiated with light onto the target for printing, the head section having an irradiation section configured to irradiate the target for printing with the light. The method includes moving the head section with respect to the target for printing relatively in a crossing direction which crosses a direction of the lined up nozzles forming the nozzle row, emitting the photocurable ink from the respective nozzles in the nozzle row onto an image forming area of the target for printing, and irradiating the photocurable ink having impacted on an area adjacent to an edge area of the image forming area and having impacted on the edge area by means of the emission of the photocurable ink with the light of first irradiation energy from the irradiation section and of second irradiation energy which is smaller than the first irradiation energy, respectively.

Incidentally, the photocurable ink having impacted on the edge area is irradiated with irradiation energy smaller than irradiation energy that the area of the image forming area adjacent to the edge area is irradiated with, and then is irradiated with light of greater irradiation energy after the protrusion of the photocurable ink having impacted on the edge area decreases so that the photocurable ink having impacted on the edge area is hardened into the inner part.

An embodiment explained below will be exemplified by an ink jet printer (called printer 1 as well, hereafter) as being a printing apparatus.

Introduction

Thickening Phenomenon, Thick Protrusion Feeling

As target material for printing such as plastic film, etc., has a property reluctant to absorb ink, ink jet printing is sometimes carried out on such target material for printing by the use of UV ink as photocurable ink. The UV ink includes UV-curable resin having a property of being hardened upon being irradiated with ultra violet light (UV). Printing can be carried out even on a target for printing without ink absorption property having no ink-accepting layer by means of UV ink hardening and dot forming. Incidentally, target material for printing having no ink-accepting layer is, e.g., film (specifically, vinyl chloride film, polyethylene terephthalate (PET) film, etc.).

As the dot formed by the UV ink rises on the surface of the target for printing, the surface of the target for printing on which a printed image is formed by the use of the UV ink is made uneven. Further, upon being painted out, the printed image ends up having a thickness.

FIG. 1A illustrates an image printed on a target for printing by the use of UV ink.

The UV ink can be instantaneously hardened by means of ultra violet light (UV). Thus, if an image is printed by the use of the UV ink, dots protrude and are formed independently of the property of ink absorption of the target for printing. If a painted-out image is printed, dots formed by UV ink entirely cover a particular area, resulting in that a printed image G having a thickness is formed on a target for printing S. If a letter is printed on the target for printing S, e.g., a letter image (painted-out image) having a thickness is formed on the target for printing S. The printed image G printed by the use of the UV ink is a couple of μm thick.

Figure 1B:
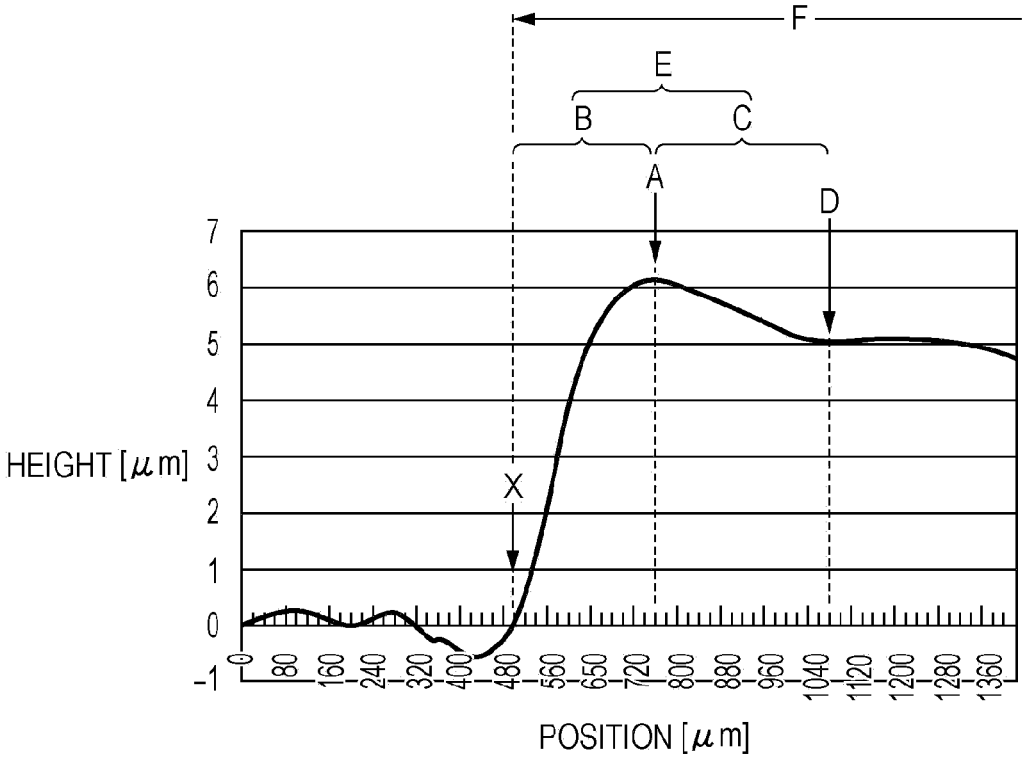
FIG. 1B is a graph of measured thickness of an area indicated with a dotted line (close to an edge) shown in FIG. 1A.

FIG. 1B is a graph of measurements of thickness of an area T (close to an edge) indicated with a dotted line in FIG. 1A. The graph has horizontal and vertical axes which indicate a position on the target for printing S and height of the dot (thickness of the printed image G), respectively. Incidentally, the printed image G is formed by dots of ink each having a weight of 10 ng and is painted out with a resolution of 720×720 dpi. The thickness of the printed image G is measured by the use of a nonstop CNC (Computer Numerical Control) image measuring instrument "Quick Vision Stream plus" made by Mitutoyo Corporation. The printed image G is around 5 μm thick as shown in FIG. 1B.

In the graph, a position X indicates an outermost position in the printed image G. In other words, the position X indicates a position of an edge of the printed image G. In the graph, further, a position A indicates a position where the printed image is thickest (highest) close to the edge. In other words, the position A indicates a position of a portion of the printed image G sticking out close to the edge.

The position A is closer to the center than the position X by around 200 μm. The ink layer is thicker at a position closer to the center in an area between the position X and the position A (area B in the graph). The ink is thickest (around 6 μm) at the position A. Further, the printed image G (ink layer) thins toward the inside (to the right in the drawing) in an area between the position A and a position D (area C in the graph). Then, the ink layer reaches a thickness of around 5 μm at the position D, and is substantially equally thick closer to the center than the position D.

The portion close to the edge such as at the position A in the graph in particular protrudes higher than other portions, which is called a "thick protrusion phenomenon" in the specification. The thick protrusion phenomenon occurs specifically in a case where an image is printed by means of an ink jet system using UV ink. In the specification, further, a portion close to the edge of an area in which a printed image is formed (called image forming area, hereafter), specifically an area between the edge of the image (e.g., position X in FIG. 1B) and a position beyond which the image is evenly thick (e.g., position D in FIG. 1B) or an area formed by areas B and C gathered together, is called an edge area E. In FIG. 1B, the edge area E is an area in which a distance from the edge of the image is around 580 μm or less. In FIG. 1B, the image forming area is indicated with a symbol F.

Figure 2A:
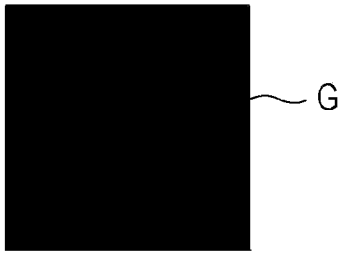
FIG. 2A gives a top view of the printed image shown in FIG. 1A.
Figure 2B:
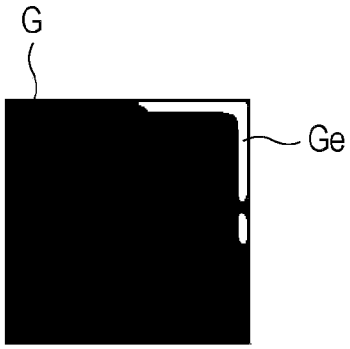
FIG. 2B illustrates how light is regularly reflected on a portion of the printed image shown in FIG. 1A.

FIG. 2A shows a top view of the printed image G shown in FIG. 1A. FIG. 2B illustrates how light is regularly reflected on a portion of the printed image shown in FIG. 2A. In FIG. 2B, a portion viewed as shining inside the printed image is indicated to look white.

The printed image is equally shiny in the middle portion of the printed image, as the thickness is substantially even there. The printed image is unequally shiny close to the edge (edge area E), though, as the thickness is uneven there.

The printed image is unequally thick close to the edge because of the thick protrusion phenomenon, and a sticking-out portion is formed inside and along the edge of the printed image. As a result, a portion of the printed image G (Ge) is sometimes viewed as shining along the edge depending upon the reflection angle of the light as shown in FIG. 2B. The light regularly reflected on the sloping area shown in FIG. 1B enters an observer's eyes depending upon relative positions and angles among the observer's eyes, the light source and the printed image, resulting in that the printed image G is viewed as shown in FIG. 2B.

If the portion of the printed image G (Ge) looks shiny along the edge, the printed image is perceived to be a solid as a whole. The printed image is perceived to be a solid as if a computer graphical 3-D object is indicated on a monitor display as a 2-D image while the 3-D object is partially brightly indicated (e.g., a 3-D object is indicated as a 2-D object according to a ray-tracing method). As a result, the observer perceives the printed image G to be thicker than it truly is, although the printed image G is truly around 5 μm thick.

The perception that the printed image is perceived to be thicker than it truly is because of the thick protrusion phenomenon is called a "thick protrusion feeling" in the specification. The problem of the "thick protrusion feeling" to be solved occurs specifically when an image is printed by means of an ink jet system using UV ink.

Incidentally, a printed image printed by means of ordinary plate printing (flexography, offset printing, etc.) has little thickness compared with an image printed by the use of UV ink. Thus, neither a "thick protrusion phenomenon" nor a problem of a "thick protrusion feeling" to be solved occurs to the printed image printed by means of the ordinary plate printing. Further, a printed image printed by means of infiltration of ink into the target for printing S has little thickness of the printed image. Thus, neither a "thick protrusion phenomenon" nor a problem of a "thick protrusion feeling" to be solved occurs to the printed image printed by means of the infiltration of ink into the target for printing S. As described above, the thick protrusion phenomenon and the thick protrusion feeling are a phenomenon and a problem, respectively, which occur specifically when an image is printed by means of an ink jet system using UV ink.

Thus, conditions of UV irradiation applied to the edge area E when an image is printed is adjusted, so that the image can be leveled off even if visited by a thick protrusion phenomenon according to an embodiment shown below.

Constitution of Printing System

Figure 3:
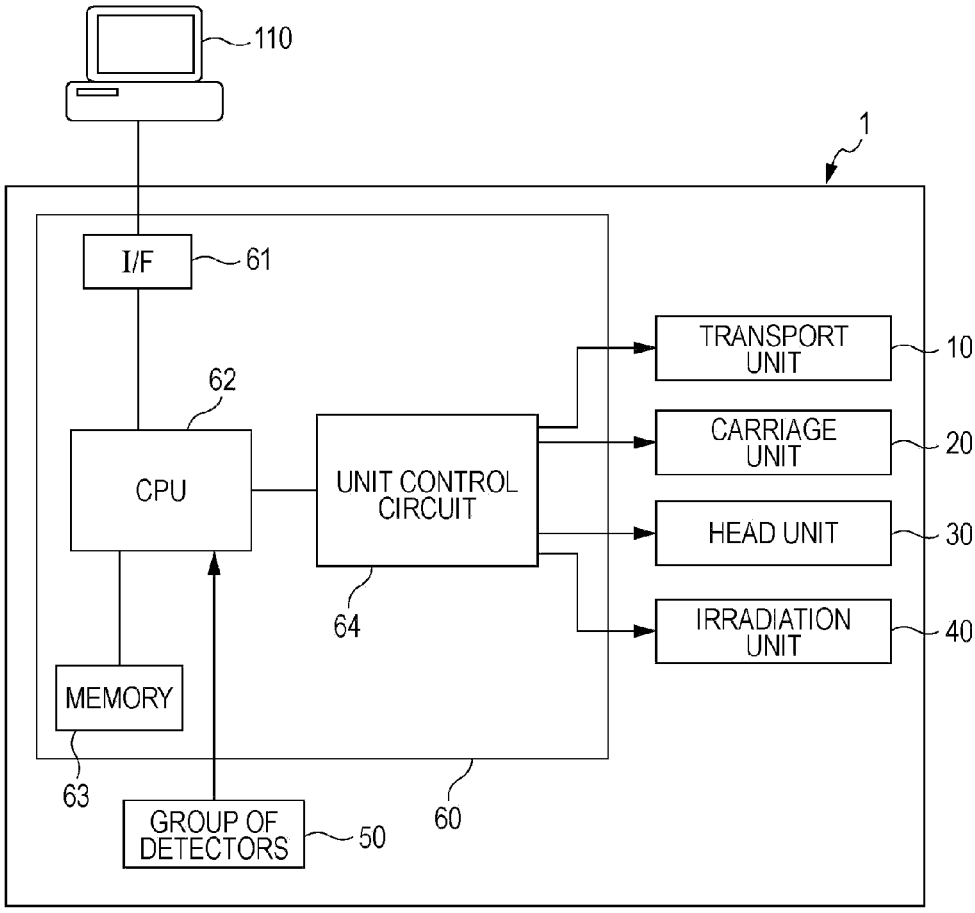
FIG. 3 is a block diagram which shows a constitution of a printing system.
Figure 4:
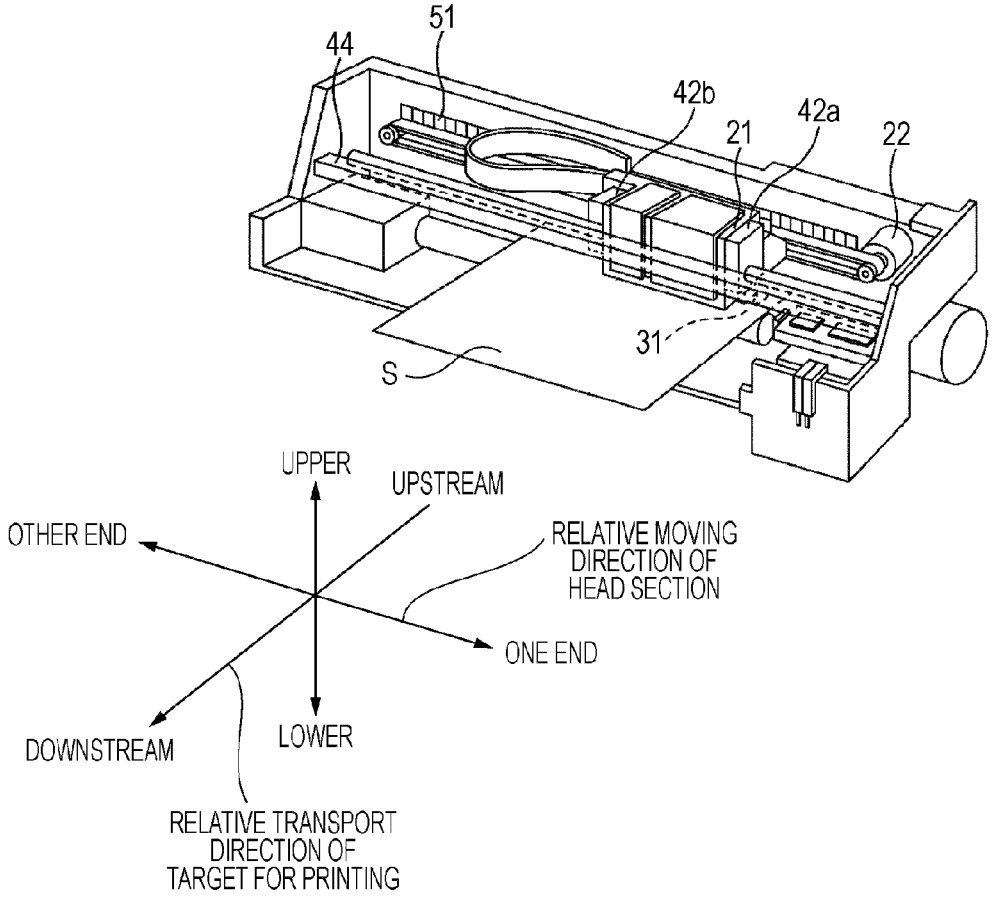
FIG. 4 gives a perspective view of a printer.
Figure 5:
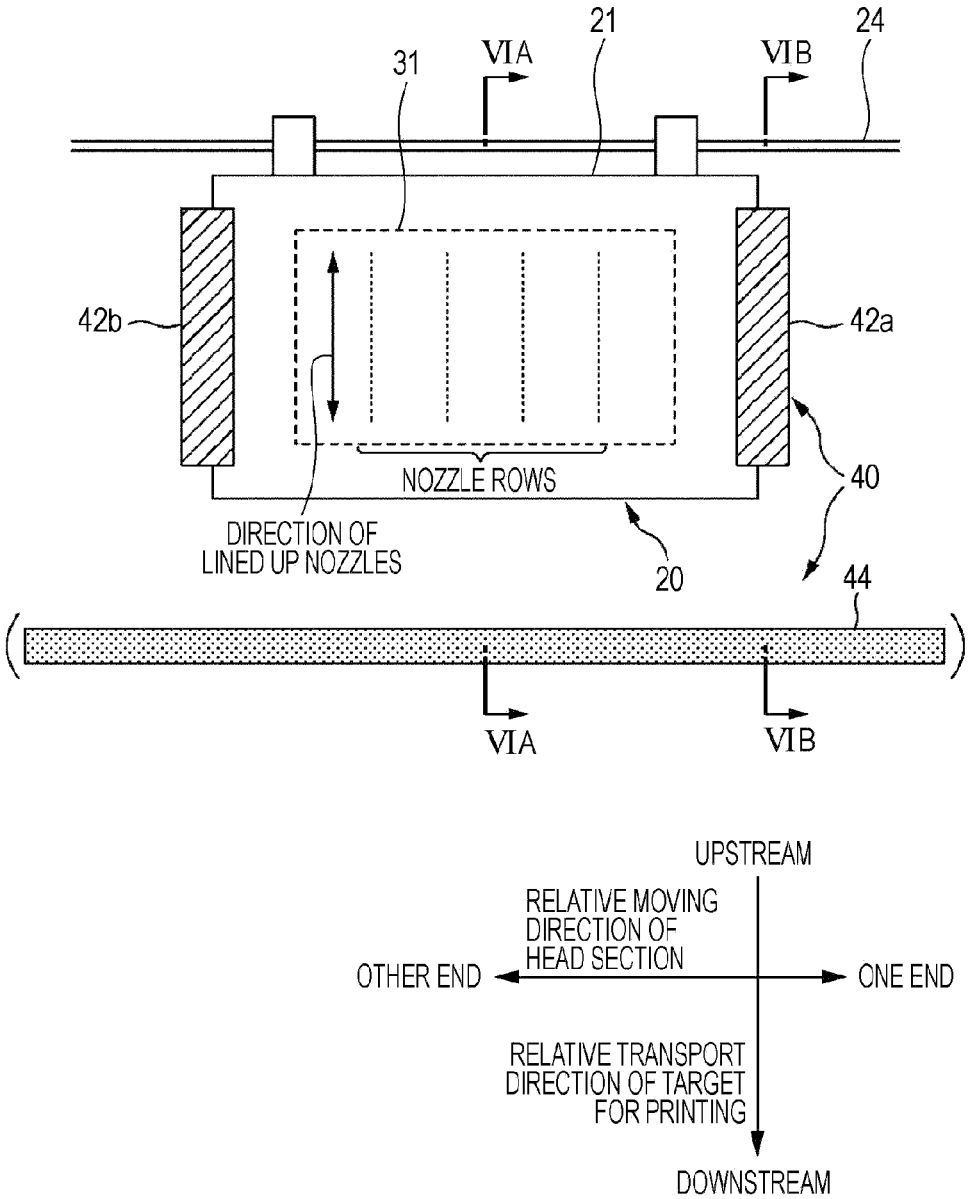
FIG. 5 schematically illustrates a portion of the printer 1 around its head.
Figure 6A:
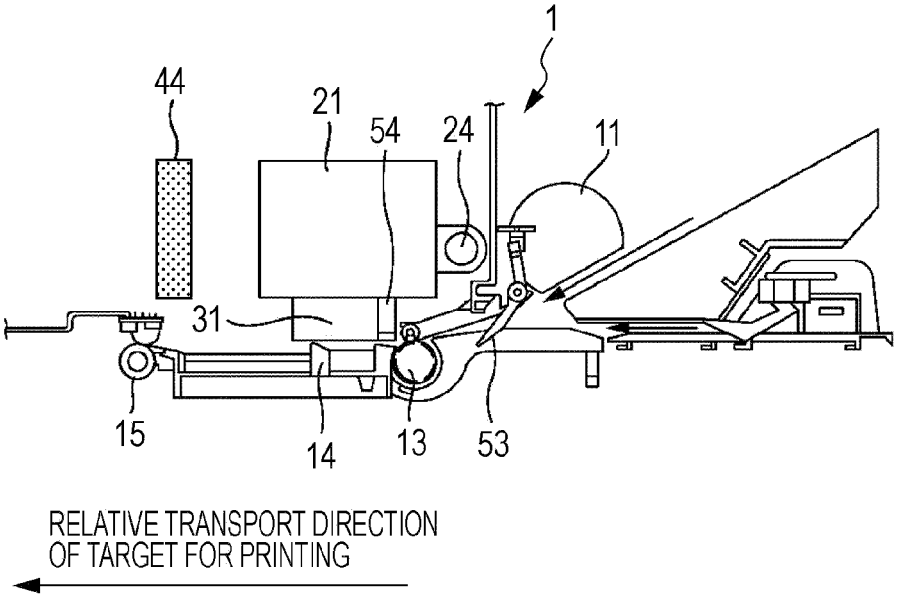
FIGS. 6A and 6B are cross sections of the printer.
Figure 6B:
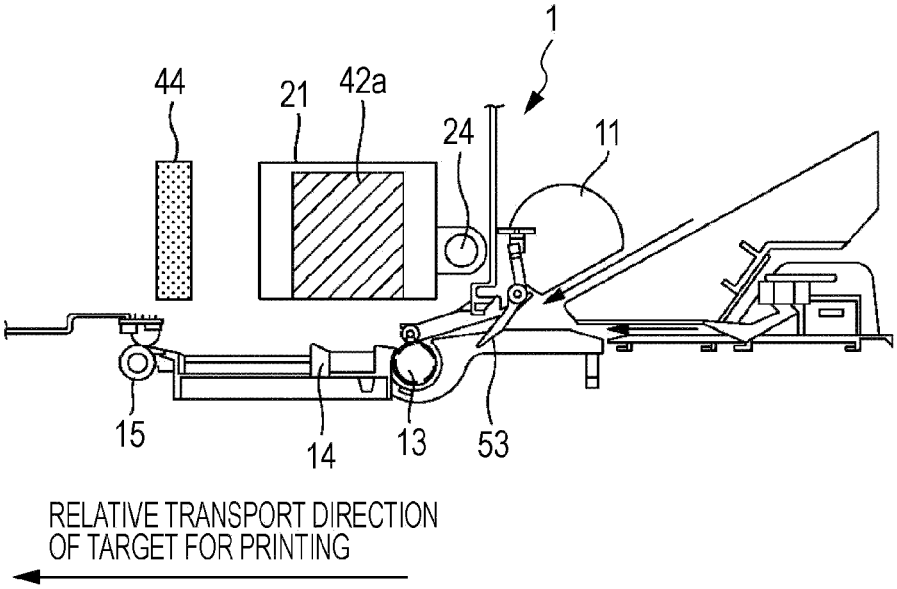

To begin with, a basic constitution of a printing system will be explained with reference to the drawings. FIG. 3 is a block diagram which shows a constitution of the printing system. FIG. 4 gives a perspective view of a printer 1. FIG. 5 schematically illustrates a portion around a head of the printer 1. FIGS. 6A and 6B are cross sections of the printer 1. FIGS. 6A and 6B correspond to an VIA-VIA section and a VIB-VIB section shown in FIG. 5, respectively.

The printer 1 and a controller 60 of the printer 1 of the embodiment of the invention correspond to a "printing apparatus" and a controller which controls the printing apparatus, respectively. Incidentally, the printing apparatus is not limited to the above and may be formed, e.g., by the printer 1 and a device (system) built on a computer 110 that a printer driver is installed in. In this case, the computer 110 may be the controller, or the controller 60 of the printer 1 and the computer 110 may form the controller.

As to Computer

The computer 110 is communicably coupled with the printer 1 as shown in FIG. 3, and provides the printer 1 with printing data according to an image to be printed so as to make the printer 1 print the image. A printer driver is installed in the computer 110. The printer driver is a program to make the computer 110 convert image data provided by an application program into printing data. The printer driver is recorded on a recording medium (computer-readable recording medium) such as a CD-ROM (Compact Disc Read Only Memory), etc. The printer driver can be downloaded to the computer 110 via the Internet, as well.

As to Printer

The printer 1 is an apparatus to emit UV ink which is hardened upon being irradiated with ultra violet light (UV), i.e., a kind of light, to a target for printing S made of paper, cloth, film sheet, etc., so as to print an image on the target for printing S. The UV ink includes UV-curable resin as described above, and is hardened upon being irradiated with UV as a photo-polymerization reaction occurs in the UV-curable resin.

The printer 1 has a transport unit 10, a carriage unit 20, a head unit 30, an irradiation unit 40, a group of detectors 50 and a controller 60 as shown in FIG. 3. Upon receiving data to be printed from an external device, the computer 110, the printer 1 controls the respective units (transport unit 10, carriage unit 20, head unit 30 and irradiating unit 40) by means of the controller 60. The controller 60 controls the respective units on the basis of the data to be printed received from the computer 110 so as to print an image on the target for printing S. The group of detectors 50 watches conditions in the printer 1 and provides the controller 60 with a detected result. The controller 60 controls the respective units on the basis of the detected result provided by the group of detectors 50.

The transport unit 10 is to transport the target for printing S (e.g., vinyl chloride film) in a relative transport direction (merely called transport direction as well, hereafter). The transport unit 10 has a paper feed roller 11, a transport motor (not shown), a transport roller 13, a platen 14 and a paper ejection roller 15 (see FIG. 6A and FIG. 6B). The paper feed roller 11 is a roller to feed the target for printing S inserted in a paper insertion slot into the printer. The transport roller 13 is a roller to transport the target for printing S fed by the paper feed roller 11 to an area where printing can be carried out, and is driven by the transport motor. The platen 14 supports the target for printing S while printing is being carried out. The paper ejection roller 15 is a roller to eject the target for printing S to the outside of the printer, and is arranged on a downstream side in the transport direction with respect to the area where printing can be carried out.

The carriage unit 20 (corresponding to a moving section) is to move the head, etc., in a direction crossing the transport direction of the target for printing S (corresponding to a crossing direction). Incidentally, the crossing direction means an orthogonal direction in general. The carriage unit 20 has a carriage 21 and a carriage motor 22 (see FIG. 4). Further, the carriage 21 holds an ink cartridge which contains ink in a removable manner. Then, the carriage 21 is equipped with a head 31 and first irradiation sections 42*a* and 42*b* described later. The carriage 21 moves back and forth, while being supported by a guide axis 24 crossing the transport direction, along the guide axis 24 by means of the carriage motor 22. Incidentally, the head 31 and the first irradiation sections 42*a* and 42*b* that the carriage 21 is equipped with correspond to a head section. That is, the direction described above in which the carriage 21 moves back and forth is a relative moving direction (merely called moving direction as well, hereafter) of the head section.

The head unit 30 is to emit liquid (UV ink according to the embodiment of the invention) to the target for printing S. The head unit 30 is provided with a head 31 having a plurality of nozzles (see FIG. 5). As being provided to the carriage 21, the head 31 moves in the moving direction if the carriage 21 moves in the moving direction. Then, the head 31 emits UV ink at intervals from the nozzles while moving in the moving direction so that a dot line (raster line) is formed on the target for printing S. As explained below, a path directed from the one end to the other end in the moving direction is called a forward path, and a path directed from the other end to the one end is called a return path. The printer 1 emits UV ink while the head 31 is moving both on the forward and return paths. That is, the printer 1 carries out bidirectional printing.

Incidentally, a constitution of the head 31 will be described later.

The irradiation unit 40 is to irradiate the UV ink impacted on the target for printing S with UV. The dot formed on the target for printing S is hardened upon being irradiated with UV by the irradiation unit 40. The irradiation unit 40 is provided with the first irradiation sections 42*a* and 42*b* and a second irradiation section 44. A dot in the edge area may be hardened close to the surface by means of the first irradiation sections 42*a* and 42*b* with small energy to irradiate the edge area, and then the dot in the edge area hardened close to the surface having collapsed and leveled off may be hardened into the inner part by means of the second irradiation section 44. Meanwhile, if a dot in the edge area may be hardened close to the surface by means of the first irradiation sections 42*a* and 42*b* with small energy to irradiate the edge area, and then the dot in the edge area hardened close to the surface having collapsed and leveled off may be hardened into the inner part by means of irradiation energy given to the edge area again by the first irradiation sections 42*a* and 42*b*, the irradiation unit 40 may lack the second irradiation section 44. Thus, the second irradiation section 44 is indicated in FIG. 5 as given in parentheses. Incidentally, the first irradiation sections 42*a* and 42*b* (each corresponding to an irradiation section) are arranged on the carriage 21. The first irradiation sections 42*a* and 42*b* thereby move in the moving direction as the carriage 21 moves in the moving direction.

If the carriage 21 moves from the right to the left, e.g., and forms UV dots on the target for printing S, and the first irradiation section 42*a* applies UV irradiation and makes irradiation energy of the UV irradiation applied to the edge area small, a dot in the edge area is hardened only close to the surface and collapses and is leveled off after time passes. Then, when the carriage 21 moves in a same scan pass area from the left to the right, the area is irradiated with large irradiation energy. The edge area receives sufficient UV irradiation, and the dot can be hardened into the inner part. One method is that the first irradiation section 42*a* irradiates the edge area with small irradiation energy when the carriage 21 moves from the right to the left, and that one or both of the first irradiation sections 42*a* and 42*b* irradiates the edge area having been irradiated with small irradiation energy with large irradiation energy when the carriage 21 moves from the left to the right immediately after the irradiation with small energy. Another method except for the above is that the carriage 21 moves from the right to the left and the first irradiation section 42*a* irradiates the edge area with small irradiation energy, then the carriage 21 moves back and forth in the same direction a couple of times, and then one or both of the first irradiation sections 42*a* and 42*b* irradiates the edge area having been irradiated with small irradiation energy with large irradiation energy so as to harden the dot into the inner part.

The first irradiation sections 42*a* and 42*b* are provided on both sides of the head 31 (respective nozzle rows, in other words), and on one end (one end in the moving direction) and an opposite end (opposite end in the moving direction) of the head 31 arranged on the carriage 21 in the moving direction, respectively, as shown in FIG. 5. Further, the first irradiation sections 42*a* and 42*b* are each arranged along the transport direction. The first irradiation sections 42*a* and 42*b* which emit light are each substantially as long as or longer than the nozzle rows of the head 31 in the transport direction (in the direction of the lined up nozzles). In other words, the first irradiation sections 42*a* and 42*b* are located alongside the nozzle rows of the head 31 in the moving direction. Then, the first irradiation sections 42*a* and 42*b* move together with the head 31, and irradiates an area where the nozzle rows of the head 31 form dots with UV so as to harden the dots. The first irradiation sections 42*a* and 42*b* each employ a metal halide lamp, a UV LED (Light Emitting Diode), etc., as a light source for UV irradiation. If the light source is an LED, a magnitude of an input current can be controlled so that the irradiation energy of UV is easily changed. Further, although not shown in FIG. 5, the first irradiation sections 42*a* and 42*b* are provided with a plurality of LEDs arranged along the transport direction (in the direction of the lined up nozzles). Input currents supplied to the respective LEDs can each be controlled so that UV irradiation conditions can be changed on every location in the transport direction. For instance, it is practical that half of the first irradiation sections 42*a* and 42*b* on the upper stream side in the transport direction emit UV and half of them on the downstream side do not.

Case Where First and Second Irradiation Sections are Used

The first irradiation sections 42*a* and 42*b* included in the first and second irradiation sections 42*a*, 42*b* and 44 may be used without the use of the second irradiation section 44, or even without installation of the second irradiation section 44 as described above. Apart from that, a case where the first irradiation sections 42*a* and 42*b* and the second irradiation section 44 are used so as to carry out irradiation will be described.

The second irradiation section 44 is arranged, e.g., fixed on the downstream side in the transport direction with respect to the carriage 21. That is, the second irradiation section 44 is arranged on the downstream side in the transport direction with respect to the first irradiation sections 42*a* and 42*b*. Further, make the second irradiation section 44 as long as or longer than the width of the image forming portion of the target for printing S to be an object for printing in the moving direction.

The controller 60 relatively moves the head 31 in the leftward and rightward directions shown in FIG. 5, emits ink onto the target for printing S and applies UV irradiation so as to prematurely harden the ink emitted onto the target for printing.

Then, the controller 60 irradiates the target for printing S transported to an area under the second irradiation section 44 through a transport operation (i.e., the target for printing S transported after the head 31 relatively moves in the leftward and rightward directions shown in FIG. 5 and ink emission and UV irradiation is carried out onto the target for printing S) with UV from the second irradiation section 44, and hardens dots on the target for printing S such that the ink hardened close to the surface and unhardened in the inner part collapses and is leveled off (mature hardening).

As to hardening due to UV irradiation done by the first irradiation sections 42*a* and 42*b* (premature hardening), an amount of irradiation of irradiated UV is small and the UV ink is hardened close to the surface but remains unhardened into the inner part (every part in the direction of thickness). Then, as the inner part of the prematurely hardened ink collapses and is leveled off as time passes and then the ink is hardened into the inner part by means of UV irradiation (mature hardening), the protrusion on the edge area can be controlled. The irradiation energy of UV applied to the dots in time of premature hardening is smaller than the irradiation energy applied to an area adjacent to the edge so as to harden the relevant area.

The second irradiation section 44 employs a UV light emitting diode (LED), a lamp (e.g., metal halide lamp), etc., as a light source for UV irradiation similarly as the first irradiation sections 42*a* and 42*b*. The second irradiation section 44 irradiates UV ink in prematurely hardened condition where only the outermost layer is hardened with UV so as to harden the UV ink into the inner part and to maturely harden (harden into the inner part of) the UV ink.

Incidentally, an amount of UV irradiation (irradiation energy) per unit area ($mJ/cm^2$) applied by each of the irradiation sections is defined as a product of UV irradiation strength ($mW/cm^2$) and irradiation time (sec). Suppose, for the embodiment of the invention, that UV irradiation time for every dot is constant in time of UV irradiation regardless of a location (position) of the dot on the target for printing S. In other words, the amount of UV irradiation (irradiation energy) depends upon the UV irradiation strength.

The group of detectors 50 includes a linear encoder 51, a rotary encoder (not shown), a paper detection sensor 53 and an optical sensor 54, etc. The linear encoder 51 (corresponding to a detector) detects a position of the carriage 21 in the moving direction. The rotary encoder detects the number of rotations of the transport roller 13. The paper detection sensor 53 detects a position of the beginning of the target for printing S being fed. The optical sensor 54 detects presence of the target for printing S by means of light emitting and light receiving portions mounted on the carriage 21. Then, the optical sensor 54 detects positions of ends of the target for printing S while moving owing to the carriage 21 so as to detect a width of the target for printing S. Further, the optical sensor 54 can detect a front end (an end on the downstream side in the transport direction, called an upper end as well) and a rear end (an end on the upper stream side in the transport direction, called a lower end as well) in accordance with conditions.

The controller 60 is a control unit (control section) for controlling the printer 1. The controller 60 has an interface section 61, a CPU (Central Processing Unit) 62, a memory 63 and a unit control circuit 64 as shown in FIG. 3. The interface section 61 transmits and receives data between an external device, the computer 110, and the printer 1. The CPU 62 is an arithmetic operation processing device for entirely controlling the printer 1. The memory 63 is to secure an area in which a program is filed for the CPU 62, a working area, etc., and has a memory element such as a RAM (Random Access Memory), an EEPROM (Electrically Erasable Programmable Read-Only Memory), etc. The CPU 62 controls the respective units via the unit control circuit 64 in accordance with the program filed in the memory 63.

The controller 60 repeats a dot forming operation to make the head 31 emit UV ink while moving the carriage 21 in the moving direction and a transport operation to transport the target for printing S in the transport direction while carrying out printing, so as to print an image formed by a plurality of dots on the target for printing S. A scan to perform a dot forming operation and UV irradiation while (relatively) moving the carriage 21 with respect to the target for printing S in a particular direction (leftwards or rightwards in the drawings) is called a "pass" as explained below. The head 31 and the first irradiation sections 42*a* and 42*b* relatively move with respect to the target for printing S in time of a pass. Incidentally, the first irradiation sections 42*a* and 42*b* perform UV irradiation at this time as described later.

As to Constitution of Head 31

Figure 7:
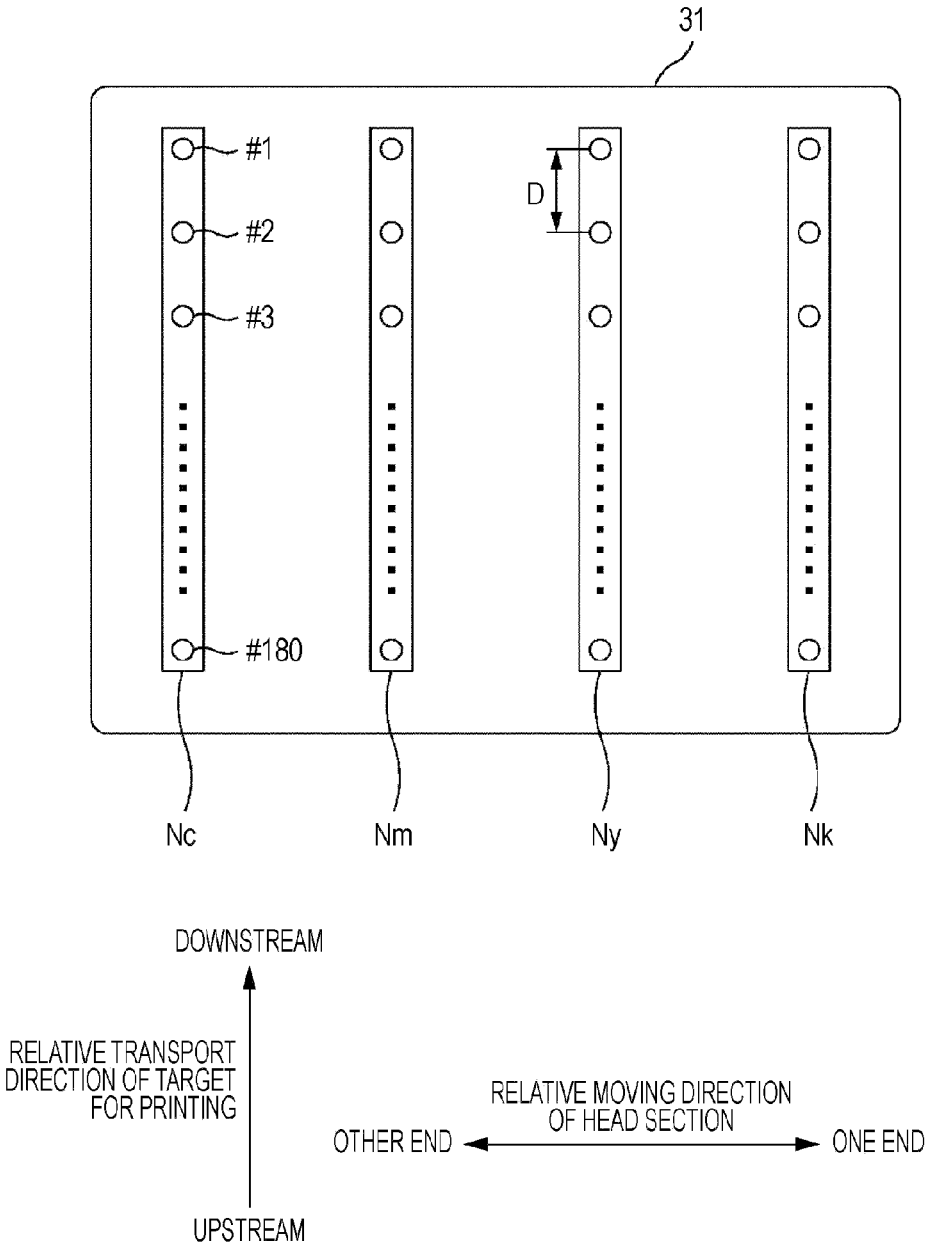
FIG. 7 illustrates a structure of the head.

FIG. 7 illustrates an exemplary constitution of the head 31. FIG. 7 gives a bottom view of the head 31 (looked up from the side of the platen 14). As shown in FIG. 7, a nozzle row of cyan ink Nc, a nozzle row of magenta ink Nm, a nozzle row of yellow ink Ny and a nozzle row of black ink Nb are formed alongside one another in the moving direction on the bottom face of the head 31. Incidentally, as the head 31 (each of the nozzle rows) is mounted on the carriage 21, each of the nozzle rows moves in the moving direction as the carriage 21 moves in the moving direction.

The nozzle rows each have a plurality of (180 according to the embodiment of the invention) nozzles, i.e., outlets through which UV ink of the respective colors is emitted.

The plural nozzles in each of the nozzle rows are lined up along the transport direction at regular intervals (nozzle pitch: D). That is, the transport direction corresponds to a direction of lined up nozzles.

Each of the nozzles arranged in the respective nozzle rows further downstream in the transport direction is given an earlier number. The nozzles are each provided with a piezo element (not shown) as a driver element for making the relevant nozzle emit UV ink. The piezo element is driven by means of a driving signal so that the nozzles each emit drops of UV ink. The emitted UV ink impacts on the target for printing S and forms a dot.

As to Detecting Position of Carriage 21

The printer 1 detects a position (in the moving direction) of the carriage 21 by means of the linear encoder 51 as described above.

Figure 8A:
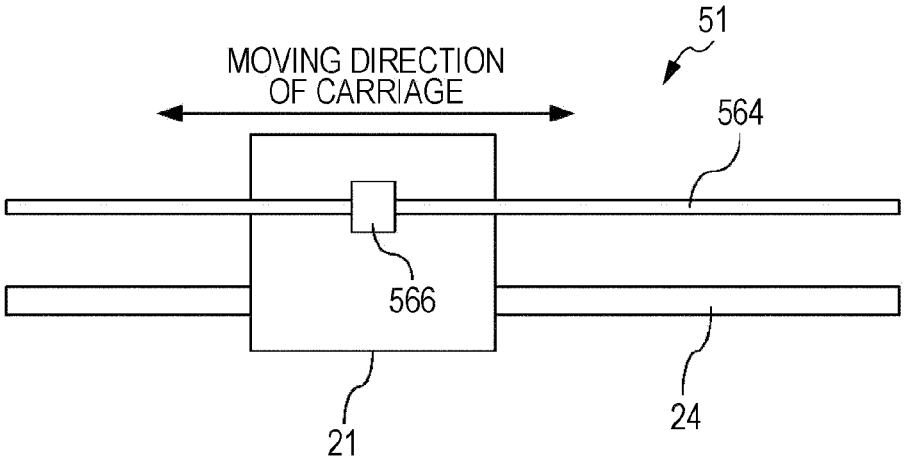
FIG. 8A schematically illustrates a structure of a linear encoder.

FIG. 8A schematically shows a constitution of the linear encoder 51. The linear encoder 51 has a linear encoder code plate 564 and a detector 566. The linear encoder code plate 564 is mounted on a frame side inside the printer 1. Meanwhile, the detector 566 is mounted on a side of the carriage 21. As the carriage 21 moves along the guide axis 24, the detector 566 relatively moves along the linear encoder code plate 564.

Figure 8B:
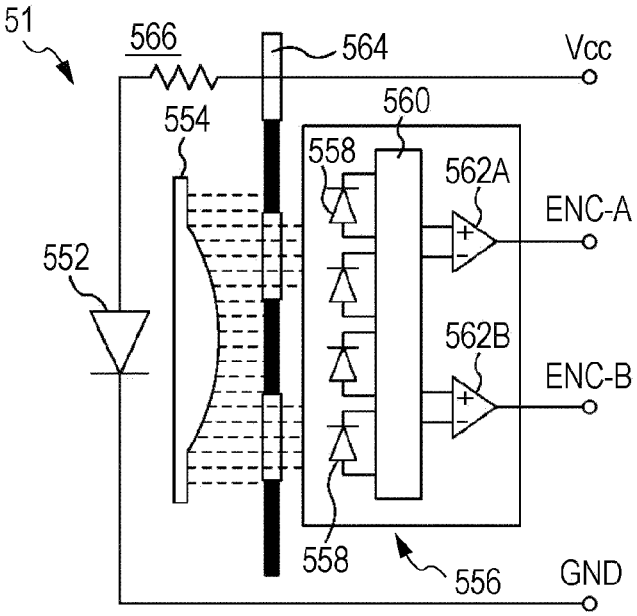
FIG. 8B schematically illustrates a constitution of a detector.

FIG. 8B schematically shows a constitution of the detector 566. The detector 566 has a light emitting diode 552, a collimator lens 554 and a detection processor 556. The detection processor 556 has a plurality of (e.g., four) photodiodes 558, a signal processing circuit 560 and, e.g., two comparators 562A and 562B.

If a voltage Vcc is applied between both ends of the light emitting diode 552 via a resistor, the light emitting diode 552 emits light. The light is gathered into parallel rays by the collimator lens 554, and passes the linear encoder code plate 564. The linear encoder code plate 564 is provided with slits at regular intervals (e.g., every 1/180 inches (one inch equals 2.54 centimeters)).

The parallel rays having passed the linear encoder code plate 564 pass a fixed slit which is not shown, come into the respective photodiodes 558 and are converted into electric signals. The electric signals provided by the four photodiodes 558 are processed by the signal processing circuit 560. Signals provided by the signal processing circuit 560 are compared by the comparators 562A and 562B, and results of the comparison are provided as pulses. Pulses ENC-A and ENC-B provided by the comparators 562A and 562B are outputs of the linear encoder 51.

Figure 9A:
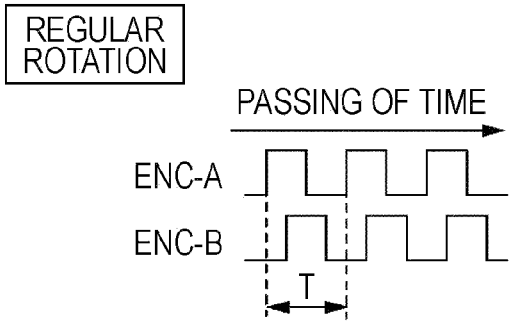
FIGS. 9A and 9B illustrate waveforms of two output signals of the detector in time of regular and reverse rotations, respectively, of a carriage motor.
Figure 9B:
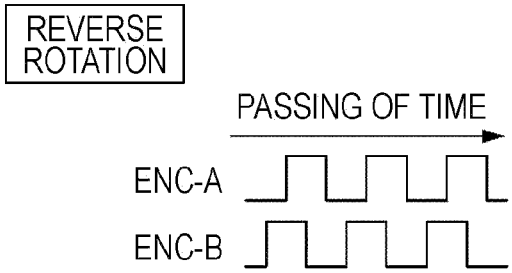

FIGS. 9A and 9B are timing diagrams indicating waveforms of two output signals of the detector 566 when the carriage motor 22 regularly and reversely rotates, respectively. As shown in FIG. 9A and FIG. 9B, the pulses ENC-A and ENC-B are out of phase by 90 degrees regardless of whether the carriage motor 22 regularly or reversely rotates. If the carriage motor 22 regularly rotates, the pulse ENC-A is ahead of the pulse ENC-B in phase by 90 degrees as shown in FIG. 9A. If the carriage motor 22 reversely rotates, the pulse ENC-A is later than the pulse ENC-B in phase by 90 degrees as shown in FIG. 9B. Further, one cycle T of the pulses ENC-A and ENC-B equals a period of time in which the carriage 21 moves over a slit separation in the linear encoder code plate 564.

Then, the controller 60 detects leading edges of the respective output pulses of the linear encoder 51, ENC-A and ENC-B, counts the number of the detected edges and calculate a rotational position of the carriage motor 22 on the basis of the counted number. In order to count the number, add "+1" to the counted number upon one edge being detected when the carriage motor 22 regularly rotates, and add "−1" to the counted number upon one edge being detected when the carriage motor 22 reversely rotates. The pulses ENC-A and ENC-B are each of a cycle which equals a period of time after a certain slit of the linear encoder code plate 564 passes the detector 566 and until a next slit passes the detector 566, and the pulses ENC-A and ENC-B are out of phase by 90 degrees. Thus, "1" of the above counted number corresponds to a quarter of the slit separation of the linear encoder code plate 564. An amount of rotational motion of the carriage motor 22 from a rotational position corresponding to the counted value "0" can thereby be calculated on the basis of the above counted number multiplied by a quarter of the slit separation. Then, the position of the carriage 21 (position in the moving direction relative to the target for printing S) can be detected from the amount of motion (amount of motion of the carriage motor 22).

The controller 60 controls ink emission from the head 31 and UV irradiation applied from the first irradiation section 42*a* and 42*b* in time of a pass on the basis of position data of the carriage 21 (i.e., position data of the carriage 21 in the moving direction relative to the target for printing S) detected by the linear encoder 51. Incidentally, resolution of the linear encoder 51 equals a quarter of the slit separation of the linear encoder code plate 564.

As to Relationship Between Hardening and Shape of UV Ink

Figure 10A:
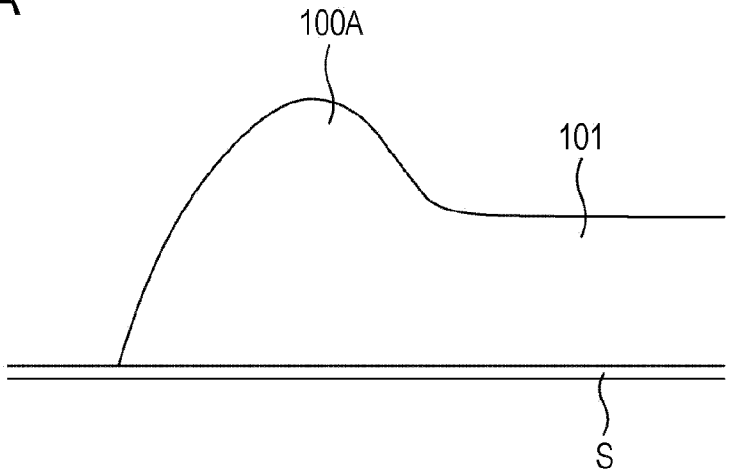
FIGS. 10A and 10B each illustrate a relationship between hardening and a shape an ink layer in an edge area.
Figure 10B:
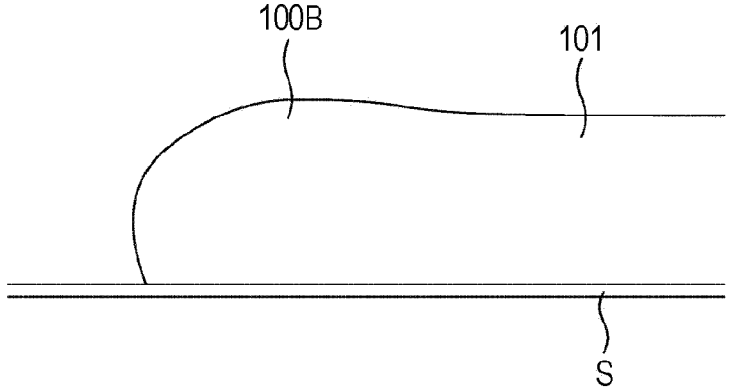

FIGS. 10A and 10B illustrate a relationship between hardening and shape of an ink layer in the edge area (schematic diagrams). Immediately after the ink impacts, an ink layer 100A protrudes higher in the edge area than an ink layer 101 in an adjacent area (inner area, on the right side in the drawing) as shown in FIG. 10A. Then, irradiate the ink layer 100A in the edge area with small irradiation energy so as to harden a portion of the ink layer 100A close to the surface (premature hardening). Irradiate the adjacent ink layer 101 with irradiation energy enough to harden the ink layer 101 into the inner part so as to harden the ink layer 101 into the inner part. As the ink layer 100A having protruded in the edge area is hardened close to the surface but is unhardened in the inner part, the ink layer 100A having protruded collapses as shown in FIG. 10B after a lapse of time to be an ink layer 100B which is as high as the ink layer 101 in the adjacent area. Then, irradiate the ink layer 100B with irradiation energy enough to harden the ink layer 100B into the inner part so as to maturely harden the leveled off ink layer 100B. According to the embodiment of the invention, the UV irradiation is controlled in the edge area so that the "thick protrusion phenomenon" and the "thick protrusion feeling" are controlled.

As to Printing Operation

Introduction to Printing Operation

The controller 60 carries out a pass to make the head 31 emit ink from the nozzles on the basis of printing data while moving the carriage 21 in the moving direction and a transport operation to transport the target for printing S in the transport direction repeatedly, so as to form dots in an image forming area on the target for printing S. Further, the controller 60 makes one of the first irradiation sections 42*a* and 42*b* being located on the upper stream side in the moving direction of the carriage 21 apply UV irradiation in time of a pass. The UV ink (dots) having impacted the target for printing S can thereby be irradiated with UV immediately, so that the dots can be hardened. Further, the controller 60 transports the target for printing S in the transport direction in the intervals between the passes (transport operation).

Incidentally, if premature and mature hardening is carried out by the use of the first irradiation sections (42*a* and 42*b*), the first irradiation sections 42*a* and 42*b* included in the first and second irradiation sections 42*a*, 42*b* and 44 may be used without the use of the second irradiation section 44, or even without installation of the second irradiation section 44 as described above.

When a dot (irradiated with UV by the first irradiation sections 42*a* and 42*b* and hardened close to the surface) formed on the target for printing S passes under the second irradiation section 44 through the transport operation before being ejected in a case where the first irradiation sections 42*a* and 42*b* and the second irradiation section 44 are used, the dot has collapsed and has been fairly leveled off. The controller 60 irradiates the target for printing S with UV from the second irradiation section 44. The dot formed on the target for printing S is thereby maturely hardened (hardened into the inner part). Such two-phase hardening can be performed.

As to Dot Forming and UV Irradiation in the Moving Direction

Figure 11A:
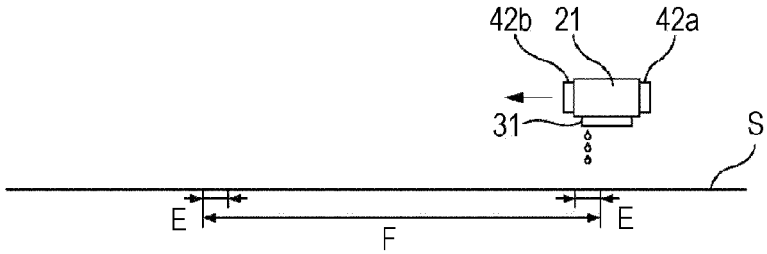
FIGS. 11A-11F illustrate a pass of the embodiment of the invention.

FIGS. 11A-11F illustrate a pass of the embodiment of the invention. Incidentally, the drawings indicate how dots are formed on the forward path (path directed from the one end to the other end in the moving direction). FIG. 11A indicates an image forming area F in which dots are (an image is) formed in time of a pass. Further, the edge area E is an edge portion of the image forming area F in which a distance from the edge of the image is a particular length (e.g., 500 μm) or less.

Figure 11B:
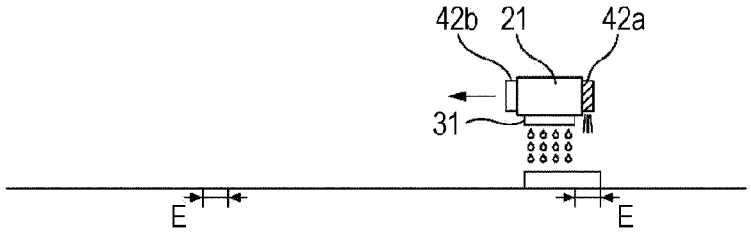
Figure 11C:
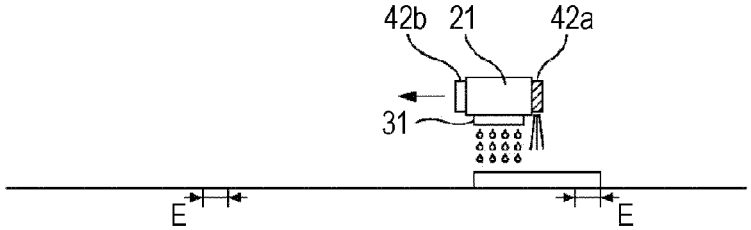
Figure 11D:
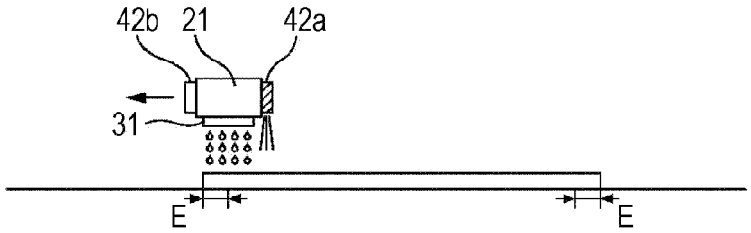
Figure 11E:
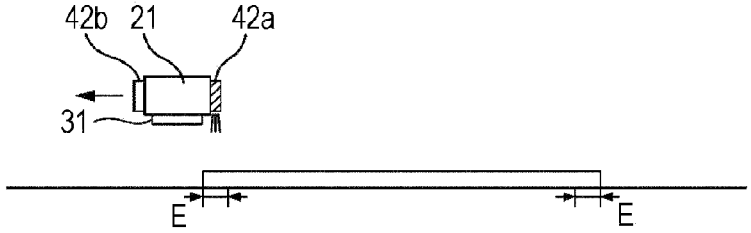
Figure 11F:
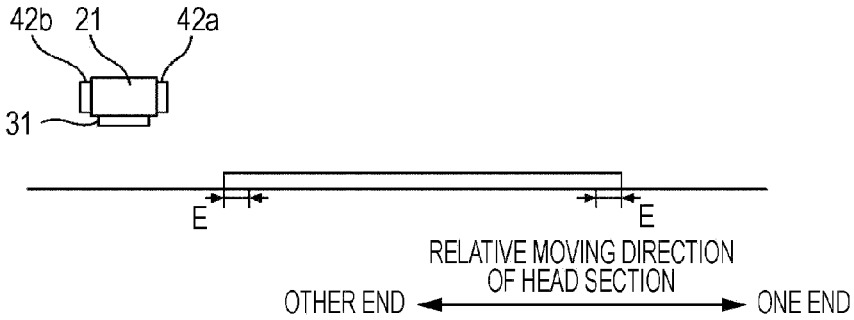
Figure 12:
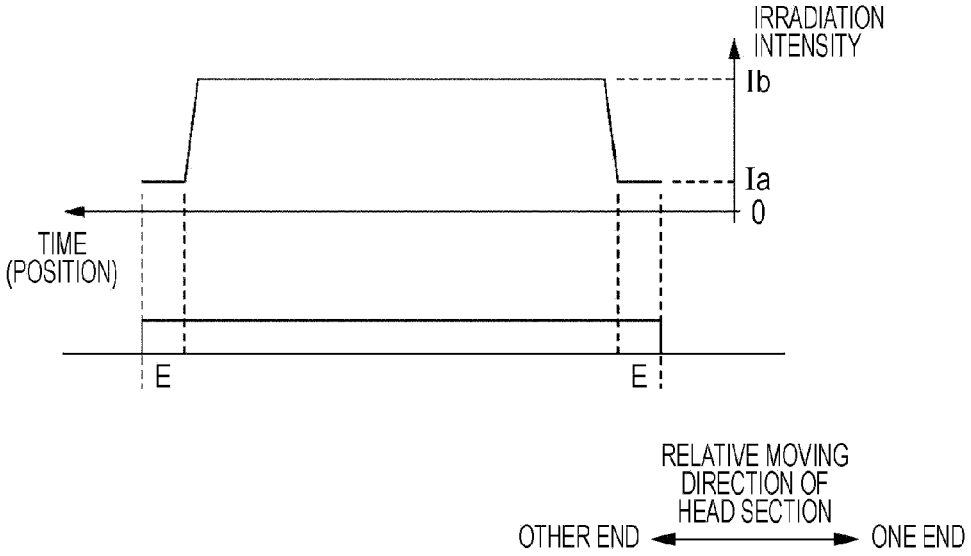
FIG. 12 illustrates a relationship between a printed image formed on the target for printing owing to the pass shown in FIGS. 11A-11F and intensity of UV irradiation.

Further, FIG. 12 illustrates a relationship between a printed image formed on the target for printing S through the pass shown in FIGS. 11A-11F and intensity of UV irradiation. FIG. 12 indicates in its lower part an image (printed image) formed on the target for printing S, and indicates in its upper part intensity of UV irradiation that the first irradiation section 42*a* applies to respective positions (areas) in the image. Incidentally, the drawing in the upper part has horizontal and vertical axes which represent time (position) and intensity of UV irradiation, respectively.

The controller 60 calculates ranges of the image forming area F and the edge area E in each of the passes from printing data received from the computer 110. Then, the controller 60 forms dots and performs UV irradiation as described below. Incidentally, the position of the carriage 21 (in the moving direction) is detected by the linear encoder 51 as described above. The controller 60 can precisely identify the positions of the head 31 and the first irradiation sections 42*a* and 42*b* on a μm basis.

The controller 60 moves the carriage 21 in the moving direction as shown in FIG. 11A, and makes the respective nozzle rows of the head 31 emit ink (UV ink) at intervals if the head 31 reaches the image forming area F in the target for printing S.

Then, the controller 60 makes the respective nozzle rows of the head 31 emit ink while continuing to move the carriage 21 in the moving direction as shown in FIG. 11B. Further, if the first irradiation section 42*a*, i.e., one of the first irradiation sections 42*a* and 42*b* being located on the upper stream side in the moving direction reaches the edge area E, the controller 60 makes the first irradiation section 42*a* irradiate the edge area E with UV of small irradiation intensity Ia (see FIG. 12). Owing to the irradiation energy in time of the irradiation intensity Ia (corresponding to second irradiation energy), the ink layer is hardened close to the surface because of the UV irradiation, but the inner part is not hardened. Thus, the dots collapse and are leveled off after the irradiation is performed (see FIG. 10B, e.g.). The protrusion as shown on the position A in FIG. 1B can thereby be reduced and the edge area E can be leveled off. The thick protrusion phenomenon can thereby be controlled.

The controller 60 makes the respective nozzle rows of the head 31 emit ink while continuing to move the carriage 21 in the moving direction as shown in FIG. 11C. Further, if the first irradiation section 42*a* reaches the area inside the edge area E (area adjacent to the edge area E) without a protrusion of the ink layer, the controller 60 sets the irradiation intensity of UV to be applied by the first irradiation section 42*a* to Ib (>Ia). Owing to the irradiation energy in time of the irradiation intensity Ib (corresponding to first irradiation energy), the ink layer in the inner area without a protrusion is hardened into the inner part.

Even after the carriage 21 reaches the edge area E of the other end in the moving direction, the controller 60 makes the head 31 emit UV ink so as to form dots as shown in FIG. 11D. Further, the controller 60 makes the first irradiation section 42*a* irradiate the inner area with respect to the edge area E with UV of the irradiation intensity Ib (thereby hardens the inner area) at this time.

After the head 31 passes the image forming area F, the controller 60 stops the head 31 from emitting the UV ink as shown in FIG. 11E. Further, when the first irradiation section 42*a* reaches the edge area E of the other end in the moving direction, the controller 60 changes the UV irradiation intensity of the first irradiation section 42*a* from Ib to Ia (i.e., decreases the UV irradiation intensity). As the UV irradiation intensity is small, a dot formed in the edge area E is not hardened in the inner part even if being irradiated with UV in the relevant area although being hardened close to the surface. Then, the protrusion in the edge area collapses and is leveled off. The protrusion as shown on the position A in FIG. 1B can thereby be reduced and the thick protrusion phenomenon can thereby be controlled in the edge area E of the other end in the moving direction as well.

Then, after the first irradiation section 42*a* passes the edge area E of the other end in the moving direction, the controller 60 stops the first irradiation section 42*a* from applying UV irradiation as shown in FIG. 11F.

Then, the controller 60 makes the target for printing S be transported in the transport direction as much as the length of the nozzle rows (transport operation). Then, the controller 60 carries out a pass on the return path similarly as it carries out the pass shown in FIGS. 11A-11F (on the forward path). For the pass on the return path, though, the one of the first irradiation sections 42*a* and 42*b* being located on the upper stream side in the moving direction is the first irradiation section 42*b*. In other words, after the head 31 comes to a certain position in the image forming area F in the pass on the return path, what moves to the relevant position is the first irradiation section 42*b*. Thus, the controller 60 controls UV irradiation so that the first irradiation section 42*b* applies UV in the pass on the return path. In this case as well, the controller 60 forms dots by emitting UV ink from the head 31 and performs UV irradiation applied from the first irradiation section 42*b* for hardening the dots similarly as on the forward path.

Although the UV ink emitted onto the target for printing S can be hardened by means of the first irradiation sections 42*a* and 42*b*, it can be hardened by the use of the first irradiation sections 42*a* and 42*b* and the second irradiation section 44 as well as described above. In the latter case, after the ink layer of the UV ink emitted onto the target for printing having protruded in the edge area is hardened close to the surface (premature hardening) by means of the first irradiation sections 42*a* and 42*b*, transport the target for printing S relatively in the transport direction, and irradiate the UV ink formed on the target for printing S (UV ink having being prematurely hardened) passing under the second irradiation section 44 with UV from the second irradiation section 44 in condition that the protrusion has collapsed so as to harden the ink layer into the inner part (mature hardening).

The controller 60 controls the UV irradiation energy of the first irradiation section 42*a* (42*b*) in time of a pass on the basis of the position data of the carriage 21 (position data of the carriage 21 relative to the target for printing S) detected by the linear encoder 51 in this way. Specifically, the controller 60 makes the UV irradiation energy that the edge area E in the moving direction is irradiated with smaller than the UV irradiation energy that the area adjacent to the edge area E is irradiated with. The dots (ink particles having impacted, ink layer, etc.) can thereby be hardened once close to the surface (premature hardening), and then the dots can collapse and be leveled off (maturely harden the dots into the inner part in this condition). Occurrence of a protrusion as shown on the position A in FIG. 1B can thereby be controlled and the relevant edge area E can be leveled off continuously to the adjacent area.

Incidentally, the UV ink can be prematurely hardened by means of UV irradiation applied by the first irradiation sections 42*a* and 42*b* and maturely hardened by means of UV irradiation applied by the second irradiation section 44, by the use of both the first irradiation sections 42*a* and 42*b* and the second irradiation section 44. In this case, make the UV irradiation energy applied by the first irradiation section 42*a* (42*b*) to the edge area E smaller than the UV irradiation energy applied to the area adjacent to the edge area E (which may be irradiated with irradiation energy enough to be hardened or prematurely hardened), so that the UV ink is hardened close to the surface but is not hardened into the inner part (premature hardening). Then, the protrusion in the edge area collapses after that, falls as high as the adjacent area and is leveled off. In condition that the protrusion has fallen, the UV ink in the edge area is maturely hardened (hardened into the inner part) by means of UV irradiation applied by the second irradiation section 44. If the area adjacent to the edge area E is hardened, harden only the edge area E without UV irradiation applied by the second irradiation section 44.

As to Dot Forming and UV Irradiation in Edge Area in Transport Direction

Figure 13:
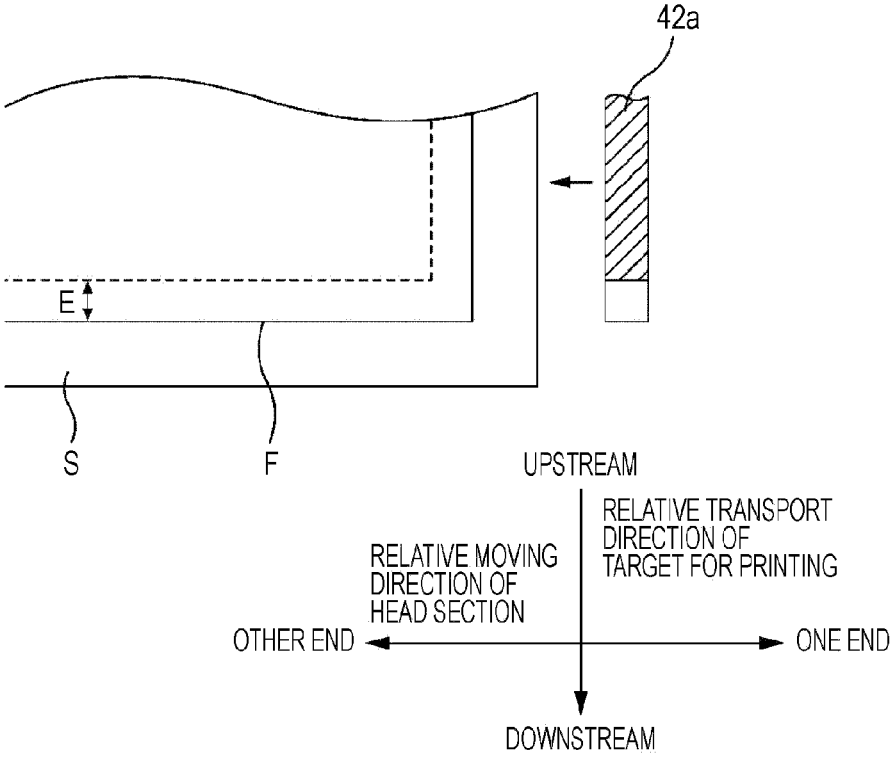
FIG. 13 schematically illustrates how printing is carried out on a portion of an image forming area close to an edge in a transport direction.

FIG. 13 schematically illustrates printing onto an edge portion of the image forming area F in the transport direction. FIG. 13 illustrates UV irradiation applied by the first irradiation section 42*a* (42*b*) in a case where an image is formed on an edge of the downstream side in the image forming area F in the transport direction (e.g., in the first pass). FIG. 13 shows only the first irradiation section (first irradiation section 42*a*, here) for simplified explanation, and the carriage 21 or the head 31 are omitted to be drawn.

The first irradiation section 42*a* has a plurality of LEDs arranged along the transport direction (direction of lined up nozzles) as a light source for UV irradiation as described above. Control input currents provided to the respective LEDs so that condition of UV irradiation (e.g., intensity of irradiation) can be changed depending upon a position in the transport direction (direction of lined up nozzles).

In case of the first pass (when printing is carried out on an edge of the downstream side of the image forming area F in the transport direction, in other words), the controller 60 changes the condition of UV irradiation applied by the first irradiation section 42*a* depending upon the position (position in the transport direction) as shown in FIG. 13.

When the first irradiation section 42*a* moves in the moving direction (i.e., when the carriage 21 moves in the moving direction) in case of FIG. 13, e.g., change the intensity of UV irradiation applied by a portion of the first irradiation section 42*a* given diagonal hatching depending upon the position in the moving direction as shown in FIG. 12 described above (prematurely harden the UV ink with small irradiation energy in the edge area E, and maturely harden the UV ink with large irradiation energy in the inner area such as the area adjacent to the edge area E). Meanwhile, fix the intensity of UV irradiation applied by a portion of the first irradiation section 42*a* which passes above the edge area E on the downstream side of the image forming area F in the transport direction (white portion in the drawing) in time of a pass (e.g., to irradiation intensity Ia) (prematurely harden the UV ink with small irradiation energy in the edge area E). After the edge area having protruded and prematurely hardened collapses and is leveled off, further apply UV irradiation to and maturely harden the UV ink. An occurrence of a thick protrusion phenomenon can thereby be prevented in the edge area E on the downstream side in the transport direction as well. Incidentally, the edge area E on the upper stream side in the transport direction may be similarly treated. A thick protrusion phenomenon can thereby be prevented in the edge area E in the transport direction, as well.

The controller 60 of the printer 1 controls the UV irradiation in order that the UV irradiation energy applied by the first irradiation section 42*a* (or 42*b*) to the edge area E is smaller than the UV irradiation energy applied to the area adjacent to the edge area E, as explained above. Thus, as the dots are prematurely hardened in the edge area E and then maturely hardened in condition that the protrusion has collapsed, the edge area E can be leveled off and an occurrence of a thick protrusion phenomenon can be controlled. Quality of an image printed by the use of UV ink can thereby be enhanced.

Other Embodiments

The embodiment described above is to facilitate understanding of the invention, and is not to interpret the invention in a limited manner. It is needless to say that the invention can be changed and modified within the scope of the invention, and that the invention includes its equivalents.

As to Printer

Although being exemplified by a printer configured to repeat the operation to emit ink from the head 31 which moves in the moving direction and the transport operation to transport a target for printing in the transport direction (so called a serial printer) as described above, an embodiment of the invention is not limited to that. The invention can be applied, e.g., to a line printer.

Figure 14:
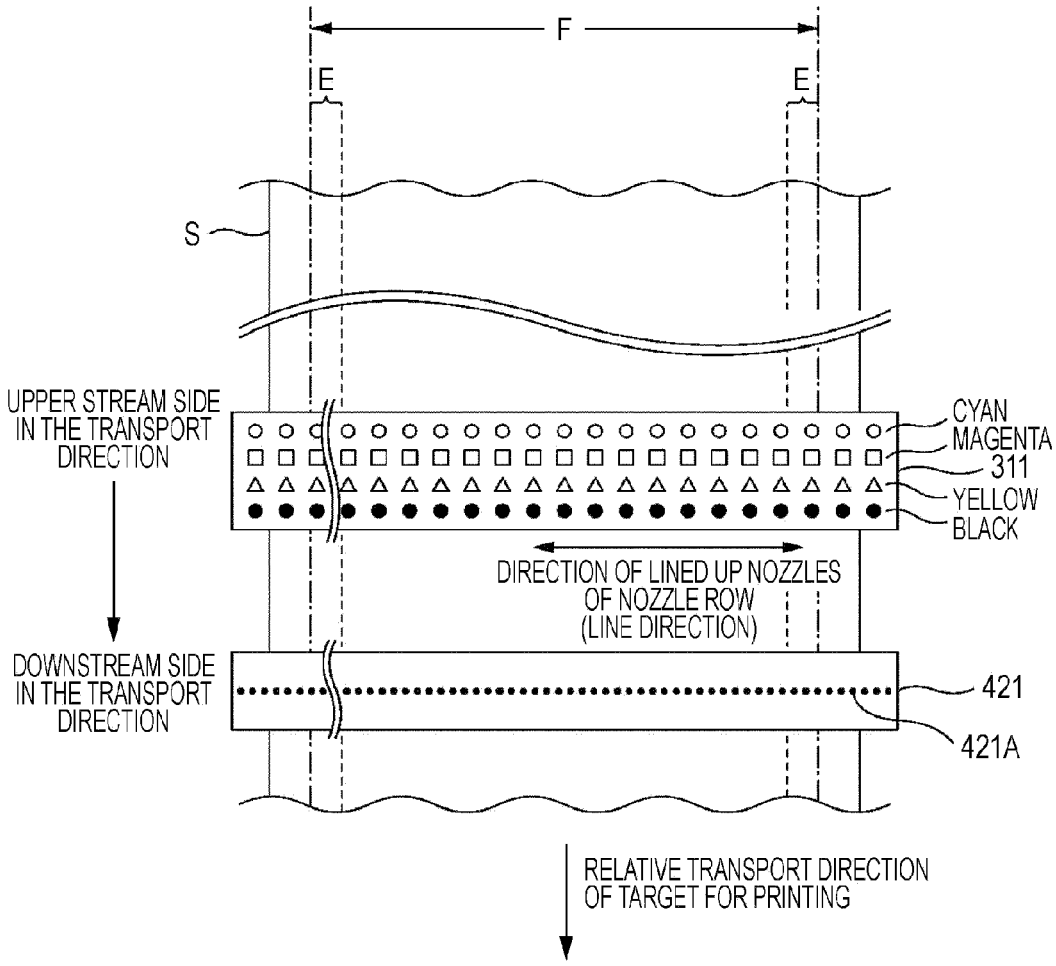
FIG. 14 schematically illustrates the embodiment of the invention carried out by means of a line printer.

FIG. 14 schematically illustrates an embodiment of the invention applied to a line printer.

The line printer shown in FIG. 14 is provided with a head 311 and a UV irradiation section 421 above a transport path of a target for printing S. A nozzle row which emits UV ink of every ink color is arranged on the head 311 in such a way as to form a line (in a line direction as shown in FIG. 14) in a relative transport direction (merely called transport direction, hereafter). The head 311 is provided, e.g., with a nozzle row of cyan ink which emits cyan ink (indicated with "Cyan" in FIG. 14) on the uppermost stream side in the transport direction. Nozzle rows of magenta ink (indicated with "Magenta" in FIG. 14) and yellow ink (indicated with "Yellow" in FIG. 14) which emit magenta ink and yellow ink, respectively, are provided in order on the downstream side of the nozzle row of cyan ink. The head 311 is provided with a nozzle row of black ink (indicated with "Black" in FIG. 14) on the lowermost stream side.

The direction of lined up nozzle rows of every ink color (line direction) crosses the direction of the relative transport direction of the target for printing S. The "crossing direction" is ordinarily an orthogonal direction. The nozzle row of every ink color (width in the line direction) is formed to be substantially as long as or longer than the width of the image forming area F in the line direction. If the image forming area F reaches the both ends of the target for printing S in the line direction, the image forming area F reaches the both ends of the target for printing S (the image forming area F is as wide as the target for printing S in FIG. 14).

Further, the irradiation section 421 is provided in a direction which crosses the relative transport direction of the target for printing S on the downstream side with respect to the head 311. The "crossing direction" is ordinarily an orthogonal direction. That is, the irradiation section 421 is arranged along the direction of lined up nozzles (line direction). The irradiation section 421 is formed to be substantially as long as or longer than the nozzle row of every ink. As the ink emitted onto the target for printing S is irradiated with UV and is hardened, the irradiation section 421 formed to be longer than the nozzle row of every ink hardly causes failed irradiation.

Further, the irradiation section 421 is provided with lots of LEDs 421A for UV irradiation along the line direction (direction of lined up nozzles). Input currents provided to the respective LEDs 421A can be controlled so that intensity of UV irradiation can be changed depending upon the position in the line direction.

In the above constitution, each of the nozzles in the respective nozzle rows of the head 311 emits UV ink and the irradiation section 421 further irradiates UV ink impacted on the target for printing S with UV while the target for printing S is being transported in the transport direction. An image is printed on the target for printing S in this way.

The respective nozzle rows and the irradiation section 421 of the head 311 of this line printer correspond to the head section. Further, a mechanism for relatively moving the head section and the target for printing S in the transport direction (e.g., transport unit) corresponds to the moving section. Incidentally, although UV ink emission (dot forming) and UV irradiation is carried out while the target for printing S is being transported in the transport direction according to the example, ink emission onto the target for printing S and UV irradiation may be carried out while the head section (head 311 and irradiation section 421) is being transported in the transport direction. That is, UV ink emission and UV irradiation may be carried out while the head section is being relatively moved with respect to the target for printing S in the transport direction (crossing direction) so that a dot row in which dots form a line in the line direction (direction of lined up nozzles) are formed all at once.

An amount of UV irradiation applied to the edge area can be controlled for such a line printer similarly as for the embodiment described above. Detect a position of the target for printing S in the transport direction from transport speed of the target for printing S and weaken intensity of UV irradiation depending upon detected position data, e.g., so as to make energy of UV irradiation applied to the edge area in the transport direction small, to prematurely harden the edge area and to harden the area except for the edge area with large irradiation energy. Further, weaken intensity of UV irradiation of the LED 421A located correspondingly to a nozzle which emits ink onto the edge area E in the line direction, make energy of UV irradiation applied to the edge area E in the direction of lined up nozzles small, prematurely harden the edge area and harden the area except for the edge area with large irradiation energy. The edge area having protruded is prematurely hardened, and then collapses and the protrusion decreases. Further apply UV irradiation in this condition, and maturely harden the edge area. Methods for maturely hardening the prematurely hardened edge area are to further provide another irradiation section 421 on the downstream side of the target for printing in the relative transport direction (below the irradiation section 421 shown in FIG. 14) and to apply UV irradiation here so as to maturely harden the edge area, to provide plural lines of LEDs 421A of the irradiation section 421 shown in FIG. 14 and to apply UV irradiation from one line when the target for printing passes so as to prematurely harden the edge area (and to harden the area except for the edge area) and further to apply UV irradiation from another line so as to maturely harden the prematurely hardened edge area when the target for printing passes.

Further, another printer to repeat an operation to emit ink onto and apply UV irradiation to a sheet of continuous-feed (or single sheet) paper transported into the printing area while moving the head and the irradiation section in the transport direction (corresponding to the crossing direction) and an operation to move the head and the irradiation section in a direction of the width of the target for printing which crosses the transport direction (corresponding to the direction of lined up nozzles) so as to form an image, and then to transport a portion of the target for printing on which printing is not yet done to the printing area will suffice. In this case, a mechanism for moving the head and the irradiation section (e.g., carriage unit) corresponds to the moving section.

It will suffice for cases of those printers to calculate the edge area in the image forming area on the basis of printed data and to make energy of UV irradiation applied to the edge area small. The edge area can thereby be prematurely hardened and then maturely hardened in condition that the protrusion of a portion having protruded has decreased so that an occurrence of a thick protrusion phenomenon can be controlled and image quality can be enhanced, similarly as for the embodiment described above.

As to Ink

Although being exemplified by the UV ink according to the embodiment described above, the photocurable ink is not limited to the UV ink. That may be ink to be hardened, e.g., upon being irradiated with visible light. Further, although four-color (cyan, magenta, yellow and black) ink is used as the UV ink of the embodiment described above, the number of ink colors is not limited to four and may be three or less or five or more.

As to System for Emitting Ink

Although being a piezo system for emitting ink from nozzles by applying voltage to a driver element (piezo element) so as to expand and contract an ink chamber, the system for emitting ink from nozzles is not limited to the above. A thermal system for emitting ink from the nozzles by means of bubbles generated in the nozzles by the use of a heat generating element, e.g., will suffice.

As to Target for Printing

An image is formed on, although not limited to, a target for printing having no ink-accepting layer according to the embodiment described above, and may be formed on a target for printing having an ink-accepting layer. A "thick protrusion phenomenon" or a "thick protrusion feeling" is remarkable if an image is printed on a target for printing having no ink-accepting layer, though, the embodiment is effective particularly if an image is printed on a target for printing having no ink-accepting layer.

As to Irradiation Section

Printing is done, although not limited to, bi-directionally according to the embodiment described above, and may be done uni-directionally. Specifically, dot forming and UV irradiation may be done on a forward path similarly as for the embodiment described above, and only UV irradiation (UV irradiation to be done by the use of the first irradiation section (s) on one or both of the sides of the carriage 21) may be done so that the dots are hardened on the return path. In this case, condition of UV irradiation may be controlled on the return path similarly as for the embodiment described above.

Further, the carriage 21 is provided with the UV irradiation sections (first irradiation sections 42*a* and 42*b*) on the both ends of the carriage 21 in the moving direction according to the embodiment described above. Although irradiation sections to be used are changed over depending upon the direction in which the carriage 21 moves for bidirectional printing, a conceivable structure is not limited to the above. The carriage 21, e.g., may be provided with an irradiation section on one end of the carriage 21 for unidirectional printing to be done. In this case, the irradiation section may be provided in such a way as to be located on an upper stream side of the head in the moving direction in time of the pass in which dots are formed. UV irradiation can thereby be done immediately after the dots are formed. Further, UV irradiation applied from the irradiation section may be controlled in this case similarly as for the embodiment described above, a thick protrusion phenomenon can be controlled in the edge area.

The entire disclosure of Japanese Patent Application No. 2011-213177, filed Sep. 28, 2011 is expressly incorporated by reference herein.

What is claimed is:

1. A printing apparatus comprising:

a head section having a nozzle row formed by a plurality of lined up nozzles each being configured to emit photocurable ink to be hardened upon being irradiated with light onto a target for printing, the head section having an irradiation section configured to irradiate the target for printing with the light;

a moving section configured to relatively move the head section with respect to the target for printing in a crossing direction which crosses a direction of the lined up nozzles forming the nozzle row; and a controller configured to carry out control so as to emit the photocurable ink from the nozzles onto an image forming area of the target for printing having relatively moved by means of the moving section and to irradiate the photocurable ink having impacted on the image forming area from the irradiation section with the light, wherein the controller controls irradiation energy of the light that the irradiation section irradiates the image forming area with so that irradiation energy of the light that an edge area of the image forming area is irradiated with is smaller than irradiation energy of the light that an area of the image forming area adjacent to the edge area is irradiated with.

2. The printing apparatus according to claim 1, wherein:

the moving section has a carriage equipped with the head section, the carriage being configured to move back and forth in the crossing direction; and the controller repeats a first operation and a second operation, the first operation including making the moving section move the carriage back and forth in the crossing direction, the first operation including emitting the photocurable ink from the nozzles onto the image forming area of the target for printing, the first operation including irradiating the photocurable ink having impacted on the image forming area from the irradiation section with the light, the second operation is to transport the target for printing in the direction of the lined up nozzles forming the nozzle row at intervals when the carriage moves back and forth in the crossing direction.

3. The printing apparatus according to claim 2 wherein, when the carriage moves back and forth in the crossing direction, the controller makes the irradiation section irradiate the edge area with the light of irradiation energy being smaller than irradiation energy of the light that the irradiation section irradiates the area adjacent to the edge area with on a certain relative move, and the controller makes the irradiation section further irradiate the edge area irradiated with the light on the certain relative move with the light on another relative move after the certain relative move.

4. The printing apparatus according to claim 2 further comprising a detector configured to detect a position of the carriage relative to the target for printing in the crossing direction, wherein the controller changes irradiation energy of the light that the irradiation section applies on the basis of data of the relative position detected by the detector.

5. The printing apparatus according to claim 2, wherein the carriage is provided with the irradiation section on each of one side and an opposite side in the crossing direction with respect to the nozzle row, and the controller carries out control so that the irradiation section provided on the one or the opposite side which moves, after the carriage moves and the nozzle row comes to a position in the image forming area of the target for printing, to the position applies the light.

6. The printing apparatus according to claim 1, wherein the irradiation section is arranged alongside the nozzle row in the crossing direction, and the controller controls irradiation energy of the light of the irradiation section according to a position in the direction of the lined up nozzles so that irradiation energy of the light of the irradiation section on a position corresponding to a nozzle which emits the photocurable ink onto the edge area in the direction of the lined up nozzles is smaller than irradiation energy of the light that the area of the image forming area adjacent to the edge area is irradiated with.

7. A line printer comprising:

a head section having a plurality of nozzle rows formed by a plurality of lines of nozzles each being configured to emit photocurable ink to be hardened upon being irradiated with light onto an image forming area of a target for printing, the head section having an irradiation section configured to irradiate the target for printing with the light;

a moving section configured to relatively move the head section with respect to the target for printing in a crossing direction which crosses a line direction of the nozzle rows; and a controller configured to carry out control so as to emit the photocurable ink from the nozzles onto the image forming area of the target for printing having relatively moved by means of the moving section, the controller being configured to control the head section so as to irradiate the photocurable ink having impacted on the image forming area from the irradiation section with the light, wherein the controller controls irradiation energy of the light that the irradiation section irradiates the image forming area with so that irradiation energy of the light that an edge area of the image forming area is irradiated with is smaller than irradiation energy of the light that an area of the image forming area adjacent to the edge area is irradiated with.

8. A method for printing an image on a target for printing by means of a printing apparatus including a head section having a nozzle row formed by a plurality of lined up nozzles each being configured to emit photocurable ink to be hardened upon being irradiated with light onto the target for printing, the head section having an irradiation section configured to irradiate the target for printing with the light, the method comprising:

moving the head section with respect to the target for printing relatively in a crossing direction which crosses a direction of the lined up nozzles forming the nozzle row;

emitting the photocurable ink from the respective nozzles in the nozzle row onto an image forming area of the target for printing; and irradiating the photocurable ink having impacted on an area adjacent to an edge area of the image forming area and having impacted on the edge area by means of the emission of the photocurable ink with the light of first irradiation energy from the irradiation section and of second irradiation energy which is smaller than the first irradiation energy, respectively.

* * * * *